US007065995B2

(12) United States Patent
Frenken

(10) Patent No.: US 7,065,995 B2
(45) Date of Patent: Jun. 27, 2006

(54) EXPANSION TOOL FOR EXPANDING TUBE ENDS AND PRESSING DEVICE COMPRISING SUCH AN EXPANSION TOOL

(75) Inventor: Egbert Frenken, Wermelskirchen (DE)

(73) Assignee: Gustav Klauke GmbH (DE)

( * ) Notice: Subject to any disclaimer, the term of this patent is extended or adjusted under 35 U.S.C. 154(b) by 166 days.

(21) Appl. No.: 10/470,515

(22) PCT Filed: Feb. 5, 2002

(86) PCT No.: PCT/EP02/01149

§ 371 (c)(1),
(2), (4) Date: Jan. 12, 2004

(87) PCT Pub. No.: WO02/062504

PCT Pub. Date: Aug. 15, 2002

(65) Prior Publication Data

US 2004/0107754 A1 Jun. 10, 2004

(30) Foreign Application Priority Data

Feb. 8, 2001 (DE) ..... 101 05 613
Feb. 21, 2001 (DE) ..... 101 08 239

(51) Int. Cl.
*B21D 22/10* (2006.01)

(52) U.S. Cl. ..... 72/62; 72/58; 72/370.08; 72/453.14; 72/466.8; 29/523

(58) Field of Classification Search ..... 72/58, 72/61, 62, 393, 466.7, 466.8, 367.1, 370.03, 72/370.06, 370.07, 370.08, 370.1, 370.13, 72/453.01, 453.13, 453.14; 29/523, 727
See application file for complete search history.

(56) References Cited

U.S. PATENT DOCUMENTS 3,595,047 A * 7/1971 Fanning et al. ..... 72/58
4,308,736 A * 1/1982 Lowe et al. ..... 72/31.06
4,320,568 A * 3/1982 Herrod et al. ..... 29/421.1
4,418,457 A * 12/1983 Mueller ..... 29/890.044
4,420,866 A * 12/1983 Mueller ..... 29/523
4,567,361 A * 1/1986 Rosenthal ..... 235/462.07
4,581,817 A * 4/1986 Kelly ..... 29/727
5,233,855 A * 8/1993 Maki et al. ..... 72/62

FOREIGN PATENT DOCUMENTS

| | | |
|---|---|---|
| GB | 1594764 | 8/1981 |
| JP | 58173035 | 11/1983 |
| JP | 02011233 | 1/1990 |
| JP | 04367336 | 12/1992 |

* cited by examiner

*Primary Examiner*—Ed Tolan
(74) *Attorney, Agent, or Firm*—Trexler, Bushnell, Giangiorgi, Blackstone & Marr, Ltd.

(57) ABSTRACT

The invention relates to an expansion tool for expanding tube ends. The expansion tool has an expansion mandrel and a counter-support, said expansion mandrel consisting of a tow-bar and an elastic rubber expansion element surrounding it. The counter-support supports the expansion element on the base extremity and radially surrounds it at a distance. In order to improve an expansion tool of the above-described kind, the tow-bar is anchored in a bolt fastening element and the counter-support can be impinged upon via a pressure bar element that projects beyond the bolt fastening element in the longitudinal direction of the tow-bar.

31 Claims, 16 Drawing Sheets

VIII
VIII
1
6
30
29
26
25
24
20
31
28
27
33
9
38
37
39
3
23
10
34
35
11
8
36
12

EXPANSION TOOL FOR EXPANDING TUBE ENDS AND PRESSING DEVICE COMPRISING SUCH AN EXPANSION TOOL

RELATED/PRIORITY APPLICATION

This application is a 35 U.S.C. §371 application of International application PCT/EP02/01149, filed on Feb. 5, 2002 and claims priority with respect to German Application No. 10105613.3, filed Feb. 8, 2001; and German Application No. 10108239.8, filed Feb. 21, 2001.

The invention relates, in the first instance, to an expansion tool for expanding tube ends, the expansion tool having an expansion mandrel and a counter-support, and, furthermore, the expansion mandrel comprising a pull rod and an elastic rubber expansion element which surrounds the latter, and the counter-support supporting the expansion element at the foot end and surrounding it radially at a spacing therefrom.

Such expansion tools for expanding tube ends are known. The tube end which is to be expanded is introduced into an annular space between the expansion element and the counter-support, whereupon, by virtue of the pull rod being moved in the direction of the counter-support base, which supports the expansion element at the foot end, the expansion element is compressed, which results in the tube end being widened.

In respect of the abovedescribed prior art, it is a technical problem of the invention to develop an expansion tool of the type in question in advantageous manner.

This problem is solved first and foremost by the subject matter of claim 1, this being based on the fact that the pull rod is anchored in a bolt-fastening element, and that the counter-support can be acted upon via a push-rod element, which projects beyond the bolt-fastening element in the longitudinal direction of the pull rod. As a result of this advantageous configuration, the expansion tool according to the invention can be attached extremely easily to conventional hydraulic devices, in particular pressing devices, which act on the expansion tool, in particular on the push-rod element, via rollers. The expansion tool according to the invention is formed such that, by virtue of the push-rod elements being subjected to pressure, for example via the rollers of a pressing device, the counter-support is displaced relative to the pull rod anchored in the bolt-fastening element, which results in the expansion of the rubber expansion element, which surrounds the pull rod and is supported at the foot end against the counter-support. Via the bolt-fastening element, the expansion tool is connected in a rigid but preferably exchangeable manner to the device acting on the push-rod element. For this purpose, it is provided that the bolt-fastening element has a bolt-accommodating bore running transversely to the axial direction of the pull rod. The expansion tool according to the invention can thus be connected extremely easily via a bolt connection to the pressing device, which acts upon the push-rod element and secures the bolt-fastening element, by means of a bolt or the like. It is further proposed that the push-rod element is secured in the counter-support. It is thus possible here to provide, for example, a screw connection. However, a welded connection is also conceivable. It is also proposed that the push-rod element passes through the bolt-fastening element. Accordingly, the push-rod element is subjected to pressure action upstream of the fastening region of the expansion tool, as seen in the actuating direction thereof, it being possible for the push-rod element to be displaced freely in its longitudinal direction in the fastening element. A preferred configuration is one in which the push-rod element is formed in the manner of a ram. Accordingly, rather than being fastened to the counter-support, the push-rod element merely butts against the latter, pressure action applied to the push-rod element being transmitted to the counter-support via the pressing device which is to be provided. The expansion tool is restored automatically via the restoring properties of the elastic expansion element which, supported at one end on the anchored pull rod, displaces the counter-support, and via the latter the ram which merely butts against it, back into the starting position. A configuration which proves to be particularly advantageous, in particular in respect of uniform force transmission, is one in which more than two push-rod elements or rams are provided. Thus, a particularly preferred configuration is one in which four push-rod elements or rams which are disposed in a rectangle, as seen in a cross-section through the push-rod elements, pass through the bolt-fastening element and act on the counter-support. In the case of an expansion tool of the type in question in the case of which the counter-support is in cup form, it is further provided that formed on the inside of the cup base is a step which accommodates a foot region of the expansion element. This configuration avoids critical convexities in the foot region of the expansion element during the expansion process. In addition, the step serves, on the upper side, as a stop for a tube which is to be expanded, which advantageously results, in conjunction with the step formed on the inside, in expansion which is uniform right to the end of the tube which is to be expanded. For tubes of different sizes, it is possible to provide different expansion tools, which can be connected to the pressing device or the like into the respective bolt-fastening element. As an alternative, it is proposed that, for the purpose of securing the pull rod, a screw-in adapter part is provided in the bolt-fastening element, for adaptation to different pull-rod diameters. This configuration proves to be advantageous in particular in conjunction with the rams which merely butt against the counter-support. It is thus possible for different pull rods and counter-supports to be associated extremely easily with the same bolt-fastening element. In a development of the subject matter of the invention, it is provided that disposed upstream of the counter-support, as seen in the direction of action, is a pressure plate, on which the push-rod elements act, and that a force-limiting device is disposed between the pressure plate and the counter-support. It is preferable for the force-limiting device to comprise a plastics-material component, the plastics-material component having a higher stiffness than the expansion element. This expansion element, in addition, may consist of a flexible plastics material which has a very high level of hardness of, for example, 90 to 100 Shore, preferably approximately 95 Shore. This is preferably a polyurethane plastics material via which pressures of up to approximately 200 bar can be produced. In order to counteract critical deformation in the region of the free end of the expansion element, which is directed away from the counter-support base, a development of the subject matter of the invention provides that an expansion transition element is disposed downstream of the expansion element, as seen in the direction of action, but is nevertheless also held captive by the pull rod. This expansion transition element preferably comprises a plastics-material component with stop-limited compression. As a result of this configuration, any possible deformation in the end region of the expansion element which may be established at high pressures is limited by a bead produced in the expansion transition element. In this respect, it is further provided that the stop-limited compression is effected by a stop sleeve which can be moved against a stop ring which bounds the expansion element, the stop sleeve, furthermore, having a sleeve base which is acted upon by a pull-rod head and merges into a tubular portion which surrounds the pull rod. Accordingly, the expansion transition element is gripped between two sleeve elements, which sleeve elements are moved together in the case of a certain compression and thus do not allow further compression of the expansion transition element. In order to ensure precise expansion of the tube end, a development of the subject matter of the invention provides that a female-die element is accommodated within the counter-support. During the expansion process, this female-die element forms a female mold into which the tube end is forced by means of the rubber expansion element. This also prevents the situation where, during the expansion, the elastomer element flows out, via the collar at the end of the pull rod, into a gap between the collar and tube end, which results in uncontrolled further expansion of the tube end. The female-die element may be in the form of half-shells which can be screw-connected by hand and support the end region of the tube which is to be expanded. A preferred configuration, in contrast, is one in which the longitudinally split female-die element is made up of a plurality of female sub-dies, that is to say, for example, of four quarter-shells which each form a 90° circle segment in cross-section. The female-die element accommodated in the counter-support, or the female sub-dies accommodated therein, can be displaced in the axial direction relative to the counter-support. In this respect, it is proposed that the female-die element engages beneath the elastic rubber expansion element, it preferably further being provided that the female-die element is held captive by way of radially oriented collars, in the region of the pull rod, between the rubber expansion element and a compression spring supported in the region of a counter-support base. It proves to be particularly advantageous that, during pressing, a female sub-die can be displaced axially from a removal position for the tube end which is to be expanded, into a pressing position, the radial distance from the pull rod being reduced in the process. As a result of this configuration, the female sub-dies of the female-die element are displaced radially, during the expansion process, in the direction of the tube end which is to be expanded, whereupon axial portions of the female sub-dies, supported at the rear by the counter-support, rest on the outer wall of the tube which is to be expanded. This precludes the formation, between the pull rod and the tube, of any annular gap into which the elastomer material of the expansion element can flow in an uncontrolled manner. The expansion of the tube end is clearly defined in its geometry, in particular along its axial extent. In respect of the radial displacement of the female sub-dies during the expansion process, an advantageous development of the subject matter of the invention provides that formed on the inside of the counter-support is a guide slope which interacts with a guide protrusion of the female-die element. In order to ensure axis-parallel displacement of the female-die element, or the female sub-dies thereof, here, it may further be provided that, in the axial direction, two spaced-apart guide slopes are disposed at different radial spacings from the pull rod.

The invention also relates to a pressing device comprising an expansion tool for expanding tube ends, the expansion tool having an expansion mandrel, which comprises a pull rod and an elastic rubber expansion element which surrounds the latter, and also having a counter-support, which supports the expansion element at the foot end and surrounds it radially at a spacing therefrom. In order to develop a pressing device of the type in question in an advantageous manner, it is proposed that the pull rod is fixed to the pressing device, while the counter-support is acted upon by a push-rod element. For actuation, the latter is displaced relative to the pull rod by the pressing device. Furthermore, it is provided that the pull rod is anchored in a bolt-fastening element, the latter serving for securing the expansion tool on the pressing device. As a result, the pull rod is connected rigidly to the pressing device via the fastening element. It is also provided that the push-rod element projects beyond the bolt-fastening element in the longitudinal direction of the pull rod. In a preferred configuration, it is provided that the bolt-fastening element has a bolt-accommodating bore running transversely to the axial direction of the pull rod, for the purpose of bolting the expansion tool to the pressing device, it further being preferred for the push-rod element to pass through the bolt-fastening element. As a result of this configuration, the push-rod element can be displaced freely in the bolt-fastening element in the longitudinal direction of the pull rod. It further proves to be advantageous, in particular in respect of improved force transmission, if more than two push-rod elements are provided. For example, there are preferably four push-rod elements, which pass through the bolt-fastening element outside the bolt-accommodating bore and, more preferably, are disposed in the form of a rectangle, as seen in a cross-section through the push-rod elements. The push-rod elements here may further be connected to the counter-support, for example screw-connected or welded thereto. A preferred configuration is one in which the push-rod element is formed as a ram which merely butts against the counter-support, but is not connected thereto. Finally, it is proposed that the pressing device acts on the rams via rollers.

The invention is explained in more detail hereinbelow with reference to the attached drawing, which merely illustrates three exemplary embodiments and in which.

Figure 1:
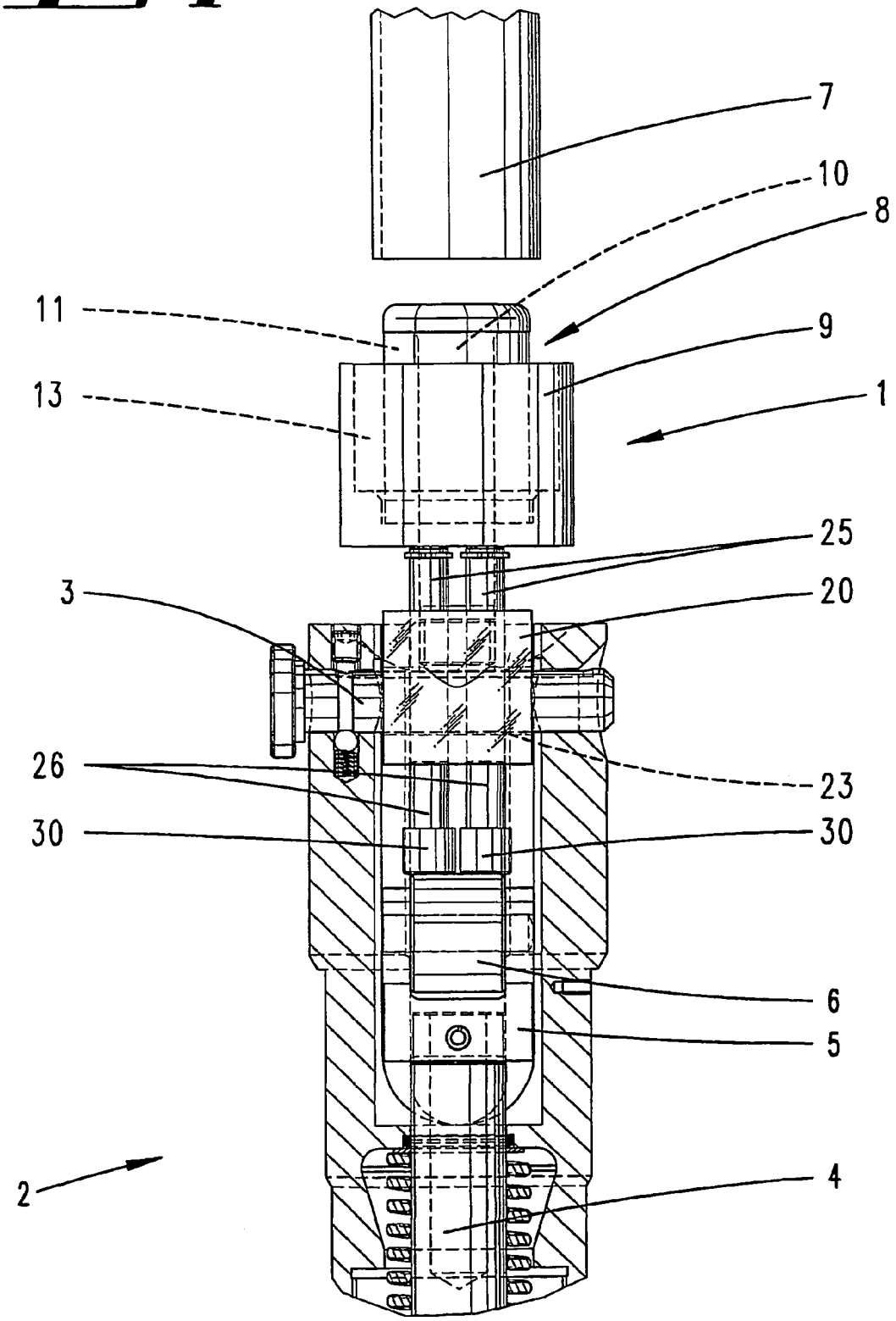
FIG. 1 shows an illustration of a pressing device with an expansion tool according to the invention in a basic position.
Figure 2:
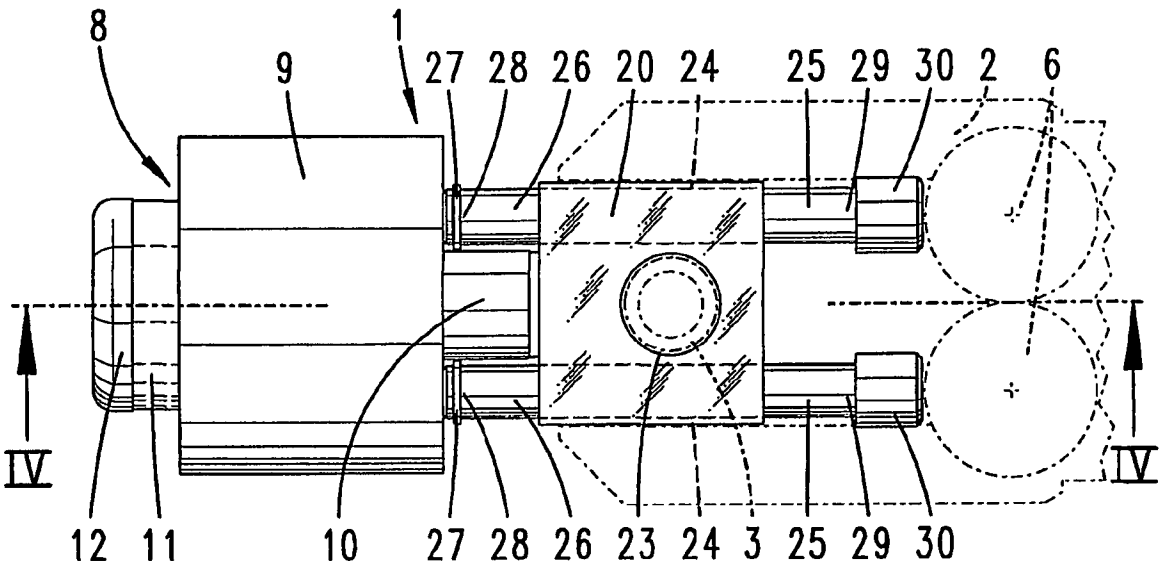
FIG. 2 shows an illustration of the expansion tool on its own, in plan view.
Figure 3:
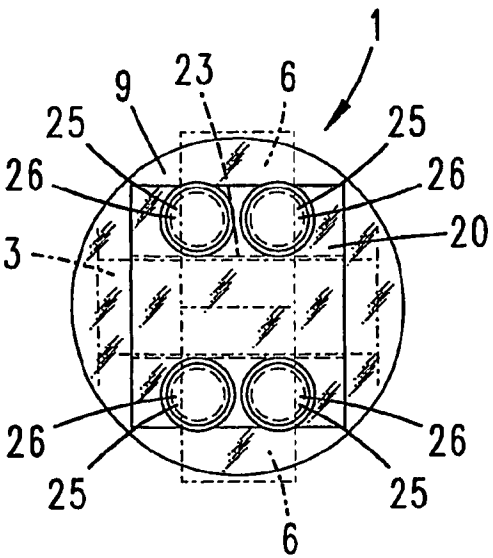
FIG. 3 shows a side view of the expansion tool.
Figure 4:
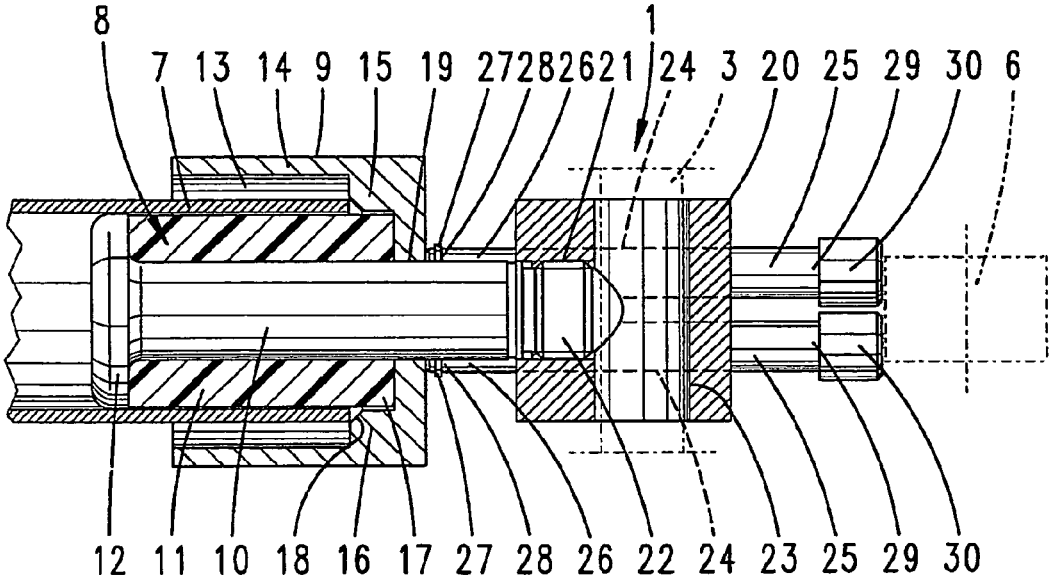
FIG. 4 shows the section along line IV—IV in FIG. 2, relating to the basic position of the expansion tool.
Figure 5:
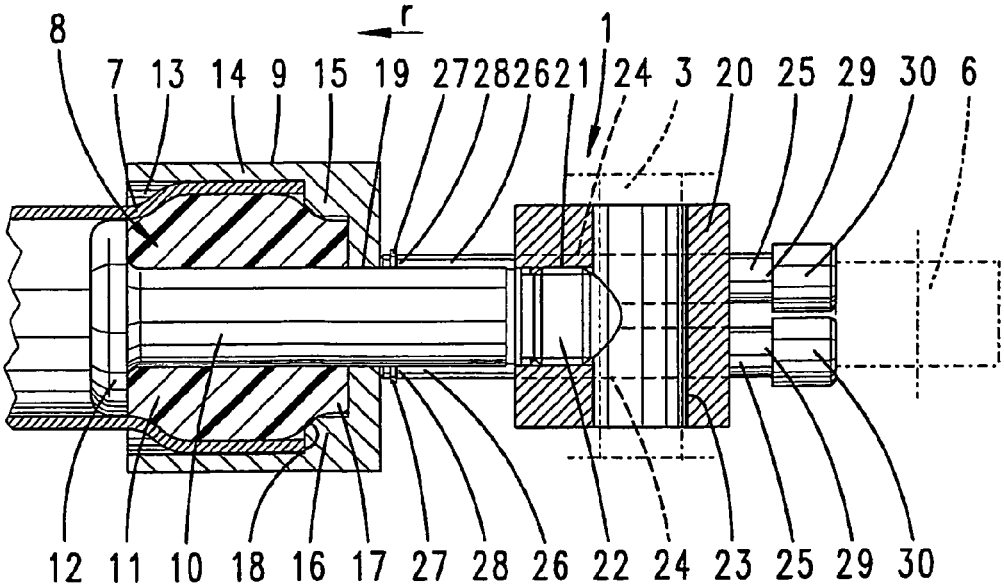
FIG. 5 shows a sectional illustration according to FIG. 4, but this time relating to the operating position.
Figures 6, 7:
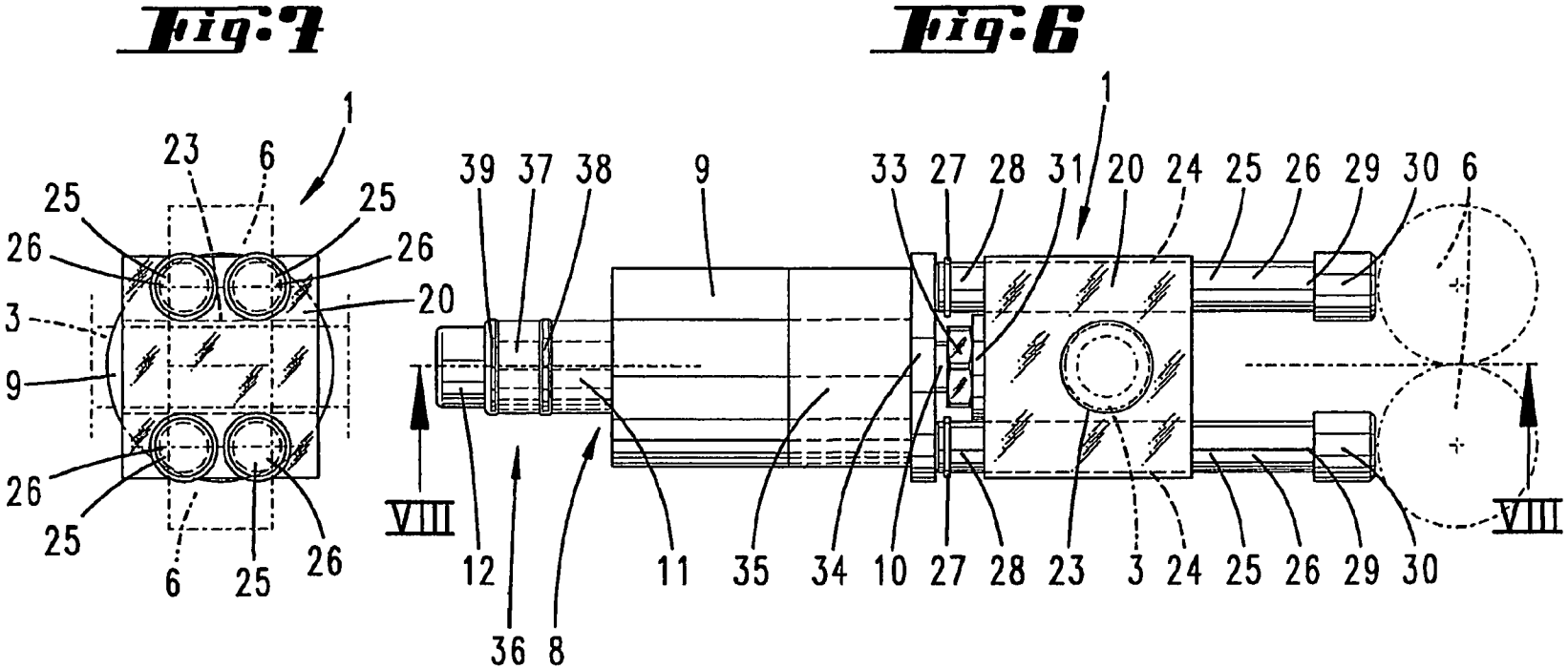
FIG. 6 shows an illustration corresponding to FIG. 2, but this time relating to a second embodiment of the expansion tool.
FIG. 7 shows a side view of the latter.
Figure 8:
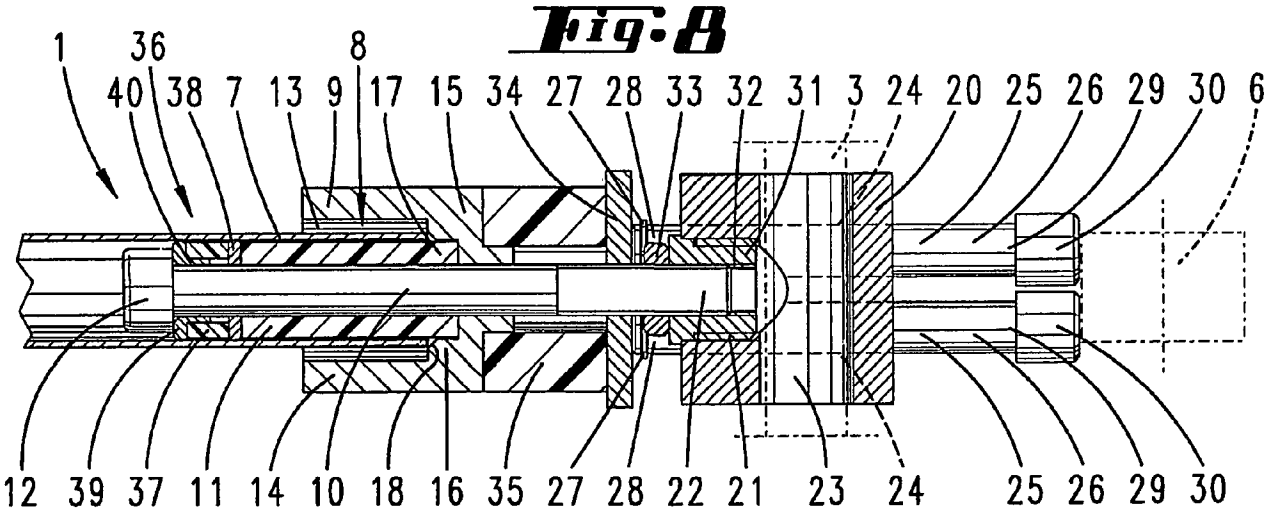
FIG. 8 shows the section along line VIII—VIII in FIG. 6, relating to the basic position.
Figure 9:
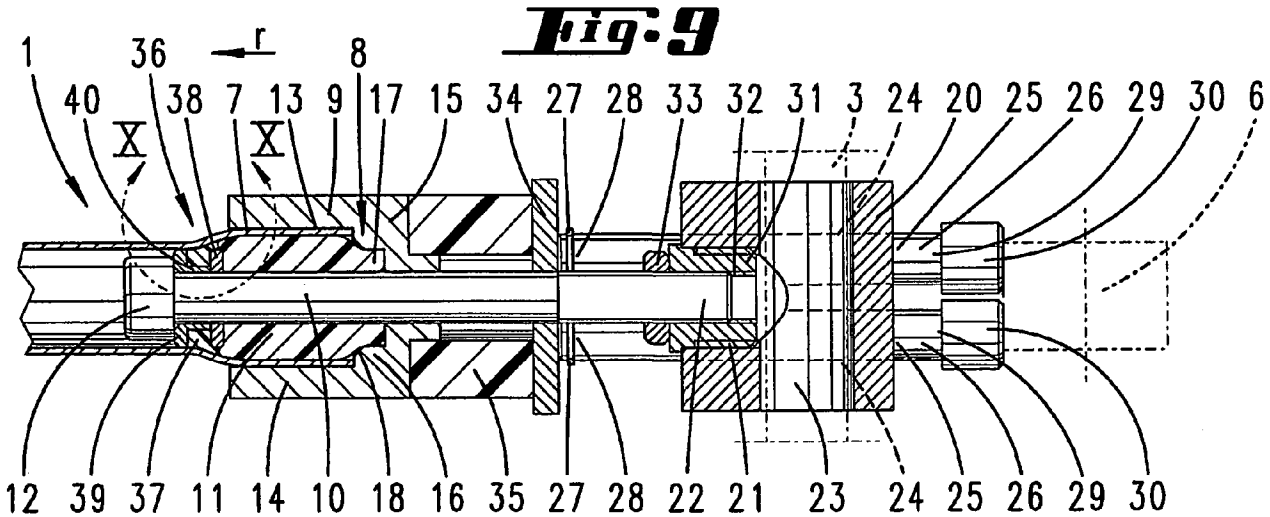
FIG. 9 shows a sectional illustration corresponding to FIG. 8, but this time relating to the operating position.
Figure 10:
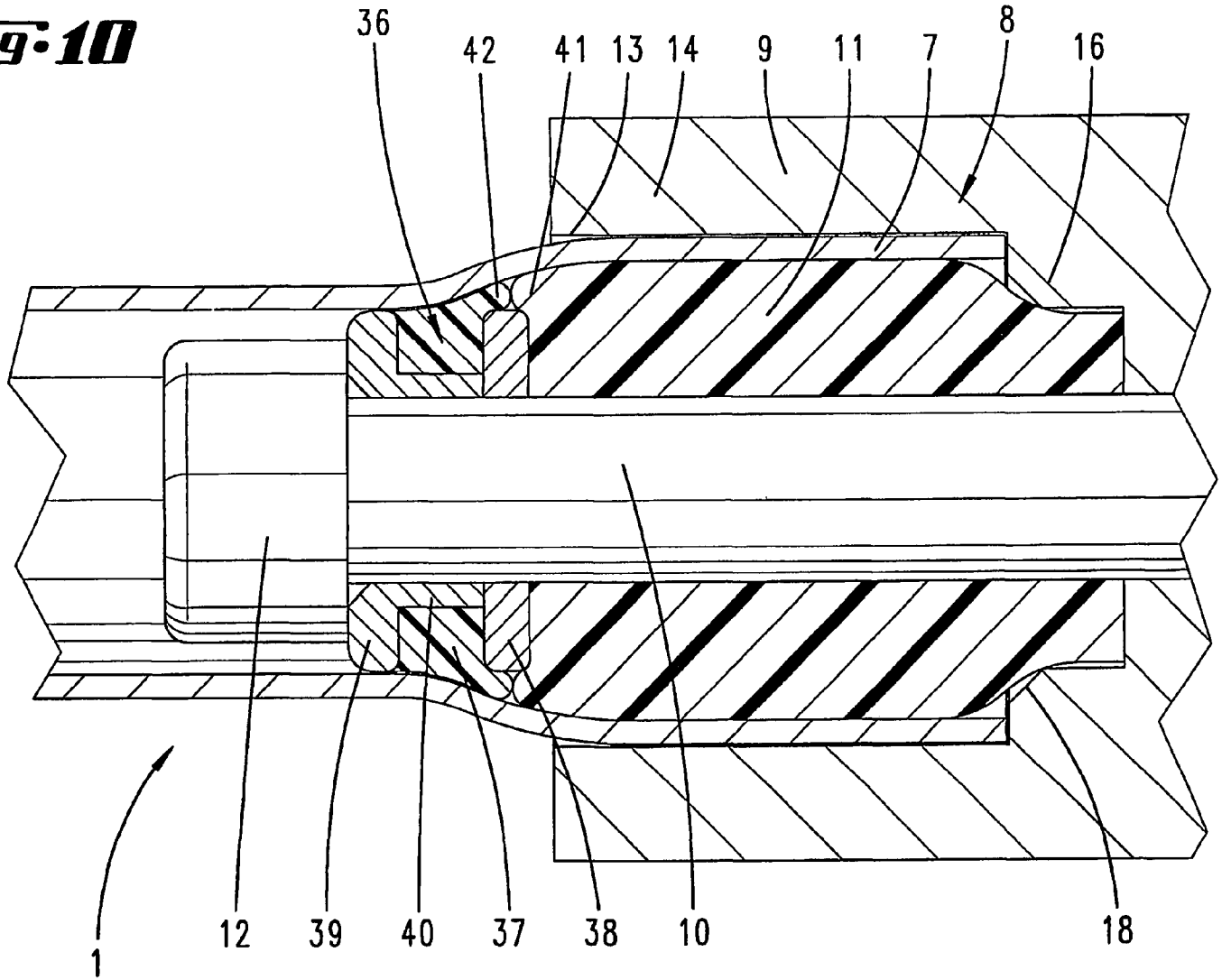
FIG. 10 shows an enlargement of the region X—X in FIG. 9.
Figure 11:
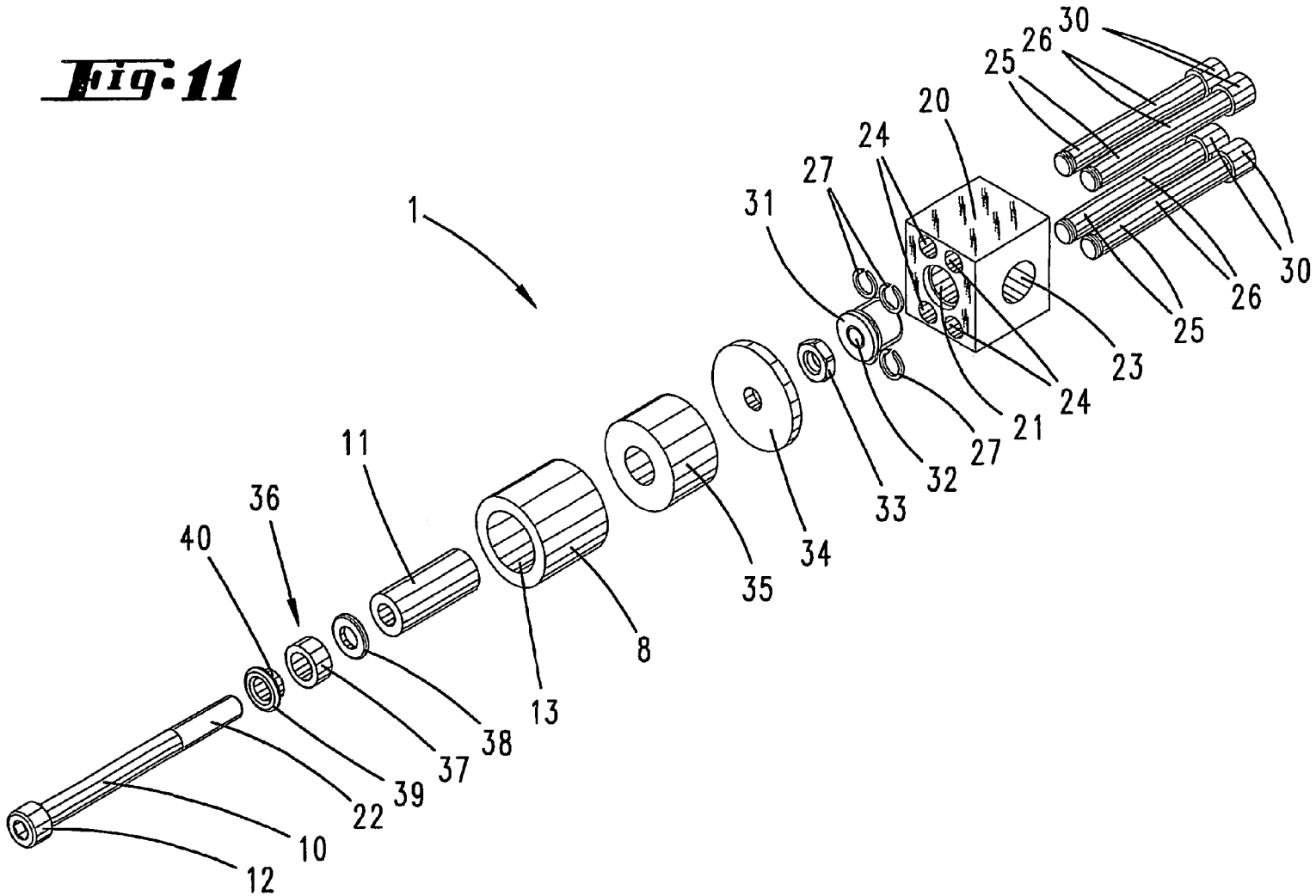
FIG. 11 shows a perspective exploded illustration of the second embodiment of the expansion tool.
Figure 12:
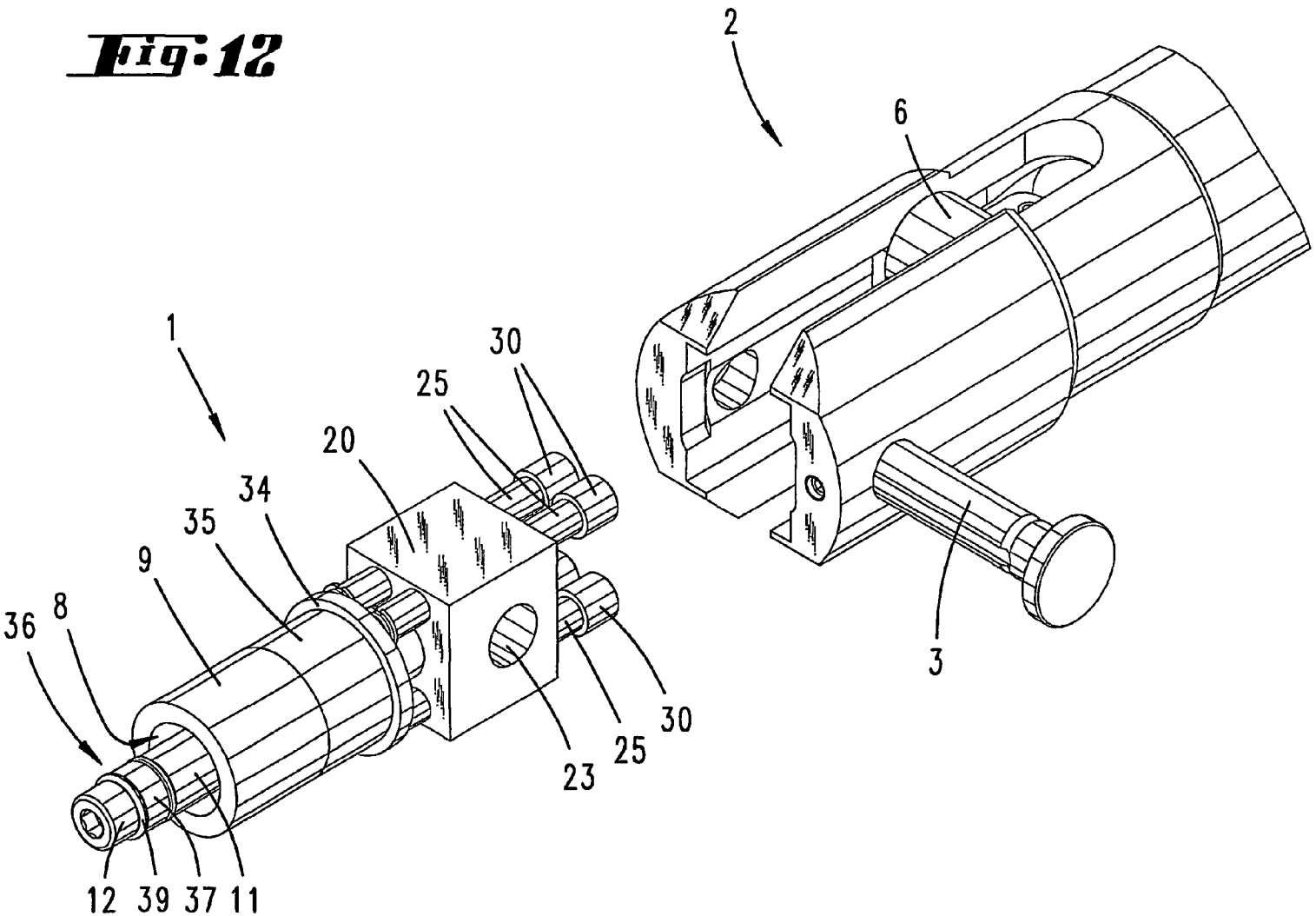
FIG. 12 shows in perspective illustration, the expansion tool, which can be disposed on a hydraulic pressing device.
Figure 13:
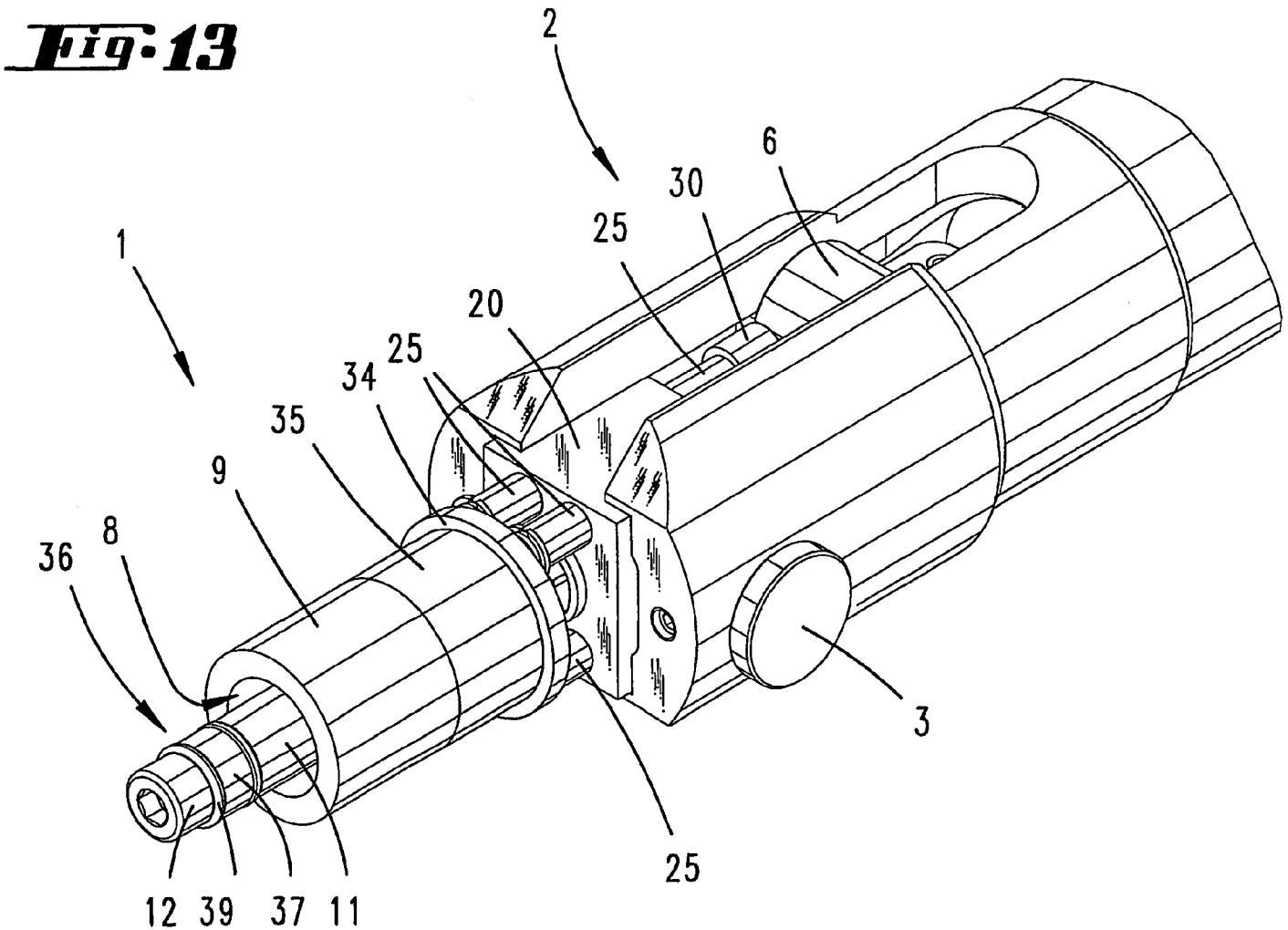
FIG. 13 shows a further perspective illustration, once the expansion tool has been disposed on a pressing device.

An expansion tool 1 for connecting to a hydraulic pressing device 2 is illustrated and described, in the first instance with reference to FIG. 1. This pressing device has a fixed bolt part 3, for fixing the expansion tool 1, as well as a moving part 5 which can be displaced hydraulically, via a piston 4, in relation to the fixed bolt part 3 and, in the exemplary embodiment shown, is substantially U-shaped in cross-section and bears two adjacently disposed displacement rollers 6 mounted in a rotatable manner. The expansion tool 1 serves for expanding tube ends 7, for which purpose the expansion tool 1 has an expansion mandrel 8 and a counter-support 9.

In a first embodiment, according to the illustrations in FIGS. 1 to 5, the expansion mandrel 8 substantially comprises a pull rod 10 and an elastic expansion element 11 which surrounds the latter and preferably consists of a polyurethane plastics material. The pull rod 10 has at one end, a pull-rod head 12, which supports the expansion element 11 and the diameter of which corresponds to that of the expansion element 11 in the non-loaded position according to FIG. 4.

The counter-support 9, which surrounds the expansion mandrel 8, is in cup form, having a receiving opening 13 which is oriented in the direction of the head end of the pull rod, remains annularly free in cross-section and is bounded radially on the inside by the expansion element 11 and radially on the outside by the counter-support wall 14. The counter-support 9 can be moved relative to the pull rod 10 along the longitudinal extent of the same.

The cup base 15 of the counter-support 9, this base being directed away from the pull-rod head 12, forms, on the inside, a step 16 which accommodates a foot region 17 of the expansion element 11, the diameter of the step 16 being adapted to the diameter of the expansion element.

The cup base 15, which is bounded by the counter-support bore 14, serves as a stop for the tube end 7 which is to be expanded. The peripheral edge in the transition region between the cup base 15 and step 16 is provided with a chamfer 18.

The pull rod 10 passes through the counter-support 9 in the region of a correspondingly adapted bore 19 of the cup base 15 and is anchored in a bolt-fastening element 20 at the end which is located opposite the pull-rod head 12. In the exemplary embodiment illustrated, this bolt-fastening element is in the form of a cuboid and, for the purpose of anchoring the pull rod 10, has a threaded bore 21 in which a threaded portion 22 at the end of the pull rod 10 engages.

This bolt-fastening element 20 serves for securing the expansion tool 1 on the pressing device 2, for which purpose the bolt-fastening element has a bolt-accommodating bore 23 running transversely to the axial direction of the pull rod 10. The fixed bolt part 3 of the pressing device 2 passes through this bolt-accommodating bore.

Furthermore, on both sides of the bolt-accommodating bore 23, the bolt-fastening element 20 has in each case two guide bores 24 which are disposed one above the other, are orientated in the axial direction of the pull rod 10 and through which push-rod elements 25 in the form of rams 26 can pass. These rams project beyond the bolt-fastening element 20 on both sides, the ends 28, which are each provided with a securing ring 27, acting upon the counter-support 9 in the region of the cup base 15 of the latter. The ends 29, which are directed away from these ends 28, are provided with radial thickenings 30, against which the displacement rollers 6 of the pressing device 2 butt in order to apply pressure.

For the purpose of expanding a tube end 7 introduced into the receiving opening 13, the pressing device 2 is actuated, this resulting, via the piston 4, in an advancement of the displacement rollers 6. The latter here act upon the rams 26, which results in the counter-support 9 being displaced relative to the pull rod 10 in the movement direction r. During this displacement of the counter-support, the expansion element 11, which is gripped between the cup base 15 or the step 16 and the anchored pull-rod head 12, is compressed, which results in it widening radially and thus in the tube end 7 widening radially according to FIG. 5. This radial widening is stop-limited by the counter-support wall 14.

Once a predetermined force has been exceeded, the piston 4 of the pressing device 2 automatically moves back into its starting position according to FIG. 1, as a result of which the rear support of the rams 26 is eliminated. The expansion tool 1 automatically moves back into the starting position as a result of the elastic properties of the expansion element 11, whereupon the expanded tube end 7 can be removed from the receiving opening 13 of the counter-support 9.

FIGS. 6 to 10 show a second exemplary embodiment of an expansion tool 1, which, as in the case of the above-described exemplary embodiment, can be acted upon by a pressing device 2. In this case, the bolt-fastening element 20 is formed in the same way as the first exemplary embodiment, a screw-in adapter part 31 being screwed into the threaded bore 21 in order to receive a pull rod 10 for smaller-diameter tube ends 7. This adapter part allows pull rods 10 with different diameters to be secured on one and the same bolt-fastening element 20. All that is required for this purpose is to screw the appropriate screw-in adapter part 31 into the threaded bore 21 in each case.

This screw-in adapter part 31, in turn, has a threaded bore 32 for receiving the end threaded portion 22 of the pull rod 10, the latter being secured via a lock nut 33.

The counter-support 9 of this second embodiment has a pressure plate 34 disposed upstream of it, as seen in the direction or action r. A force-limiting device 35 comprising a plastics-material component is disposed between this pressure plate and the counter-support 9. This plastics-material component has a higher stiffness than the expansion element 11.

In this embodiment, the push-rod elements 25 or rams 26, which pass through the bolt-fastening element 20, act upon the pressure plate 34 on the side which is directed away from the counter-support 9.

Furthermore, in this second exemplary embodiment, an expansion transition element 36 is disposed downstream of the expansion element 11, as seen in the direction of action r, but is nevertheless held captive by the pull rod 10. This expansion transition element comprises a plastics-material component 37 which has stop-limited compression and is gripped between a stop ring 38 and a stop sleeve 39, of which the tubular portion 40, which surrounds the pull rod 10, carries the cross-sectionally annular plastics-material component 37.

The stop ring 38 bounds the expansion element 11 in the end region which is directed away from the cup base 15 of the counter-support 9, and it can be displaced relative to the pull rod 10.

The stop sleeve 39 is supported against the pull-rod head 12.

The width of the plastics-material component 37, as measured along the longitudinal extent of the pull rod 10, is selected to be greater than the length of the tubular portion 40, as measured in the same direction, a free annular space which extends between the plastics-material component 37 and the pull rod 10 remaining between the free end of the tubular portion and the stop ring 38.

It is also the case in this exemplary embodiment that, in order to expand a tube end 7 introduced into the expansion mandrel 8, the push-rod elements 25 or rams 26 are forced in the movement direction r via displacement rollers 6, which results in the counter-support 9, together with the pressure plate 34 and the force-limiting device 35, being displaced in the movement direction r counter to the anchored pull rod 10. The force introduced here is limited by the plastics-material component between the counter-support 9 and pressure plate 34.

It is also the case here that, during this displacement, the expansion element 11 is compressed, the latter being widened radially in the process. As a result, the tube end 7 is expanded with stop-limited action against the counter-support wall 14.

In addition, the force introduced via the rams 26 causes the thrust stop ring 38, which bounds the expansion element 11 at the end, to be displaced axially in the direction of the stop sleeve 39 until the stop ring 38 engages with stop-limited action against the tubular portion 40 of the stop sleeve 39. In this way, there results compression of the plastics-material component 37 which is held captive between the stop ring 38 and stop sleeve 39.

As a result of this configuration, possible deformation 41 in that end region of the expansion element 11 which is directed towards the pull-rod head 12, which deformation may be established at high pressures, is limited by a bead 42 produced in the expansion transition element 36.

As is also the case for the first exemplary embodiment—a critical convexity of the expansion element 11 in the foot region 17 is countered by the latter being surrounded by the step 16.

FIGS. 14 to 20 show a third embodiment of the expansion tool 1, in the case of which, in accordance with the second exemplary embodiment, the counter-support 9 has a pressure plate 34 disposed upstream of it, as seen in the direction of action r. Here too, a force-limiting device 35 is disposed between the pressure plate 34 and the counter-support 9, this device having a higher stiffness than the expansion element 11.

In this exemplary embodiment, a female-die element 43 is accommodated within the counter-support 9 and—as is illustrated—projects axially beyond the open end of the cup-form counter-support 9.

The female-die element 43 is split in the longitudinal direction and is made up of four cross-sectionally sector-like female sub-dies 44.

In the direction of the expansion region, i.e. of the tube 7 which is to be expanded, the female-die element 43 is, or the female sub-dies 44 thereof are, formed in accordance with the desired expansion geometry. Accordingly, each female sub-die 44 has an expansion portion 49 and an abutment portion 50, the transition between the expansion portion 49 and abutment portion 50 running at an acute angle of approximately 30° in relation to the longitudinal axis.

On the inside wall, the counter-support 9 is provided with two axially spaced-apart guide slopes 45, 46, which run at an angle of approximately 45° in relation to the longitudinal axis of the expansion tool 1. In this case, the guide slope 45, which is directed towards the cup base 15, is disposed at a lesser radial distance from the pull rod 10 than the guide slope 46, which is remote from the cup base 15.

On the outer lateral surface in the region surrounded by the counter-support 9, the female-die element 43 has, or the female sub-dies 44 have, guide protrusions 47, 48 which are positioned and formed in accordance with the guide slopes 45, 46. In a non-loaded, basic position according to FIGS. 14 and 15, the guide protrusions 47, 48 of the female sub-dies 44 butt against the guide slopes 45, 46 of the abutment 9.

In addition, in the end region which is directed towards the cup base 15 of the counter-support 9, each female sub-die 44 has a carry-along portion 51 which projects radially inwards in the direction of the pull rod 10 and, with the interposition of rings 52 which can be displaced freely in the axial direction on the pull rod 10, is forced in the axial direction on the one hand by the expansion element 11 and on the other hand by a compression spring 53, which is supported on the cup base 15.

Figure 14:
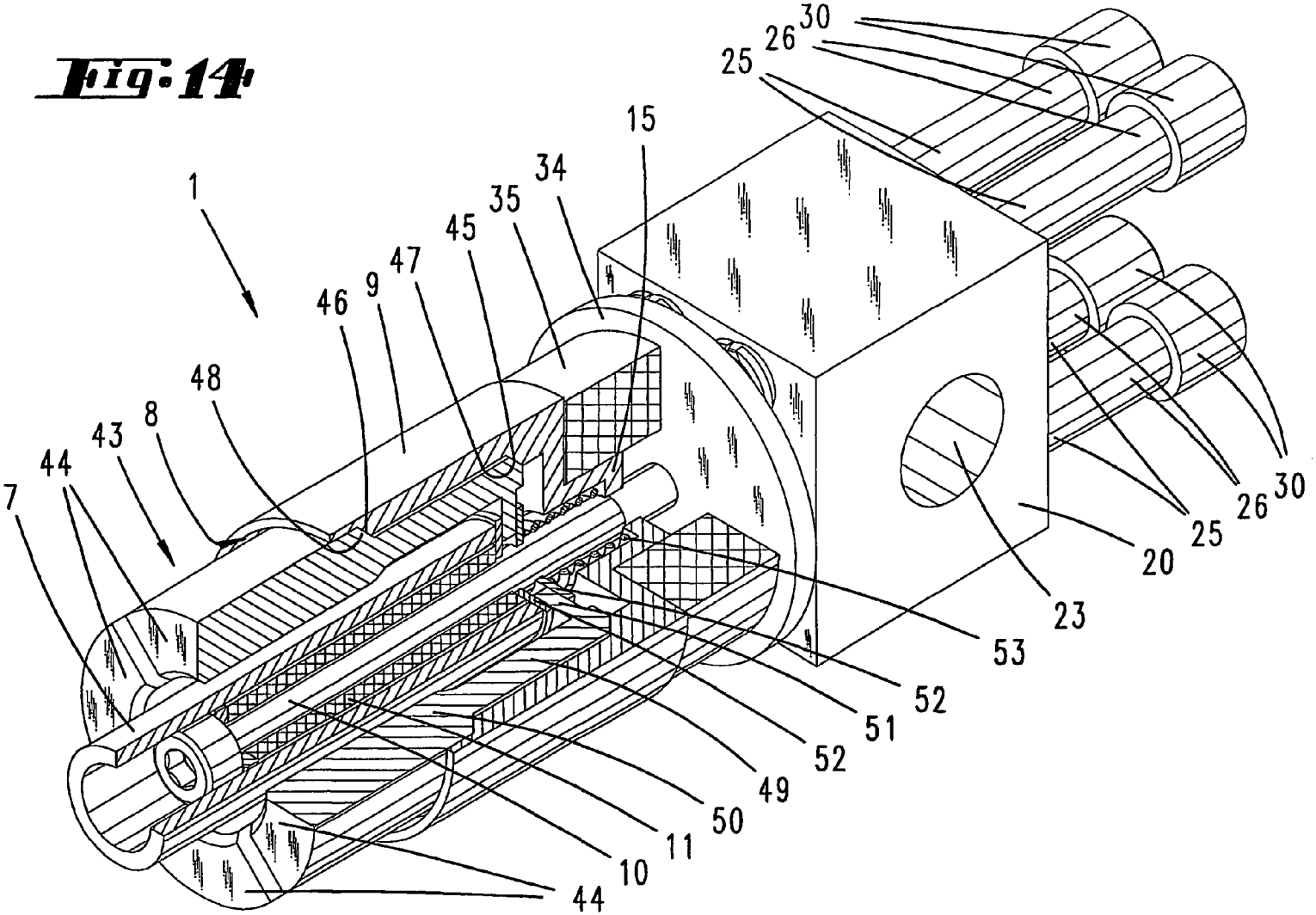
FIG. 14 shows a perspective illustration, partly in section, of an expansion tool in a third embodiment, relating to a non-loaded, basic position.
Figure 15:
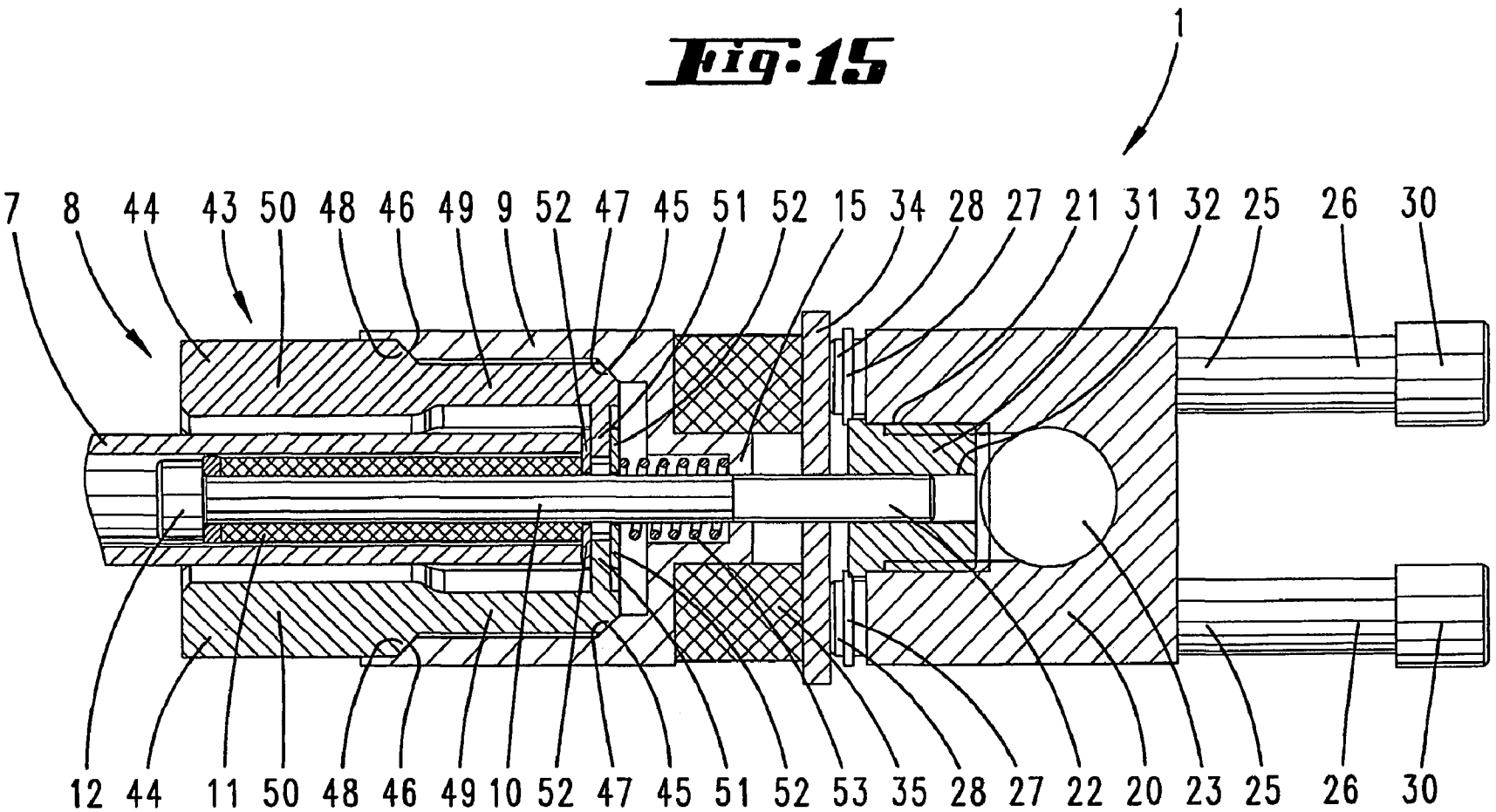
FIG. 15 shows a longitudinal section through the expansion tool according to FIG. 14.
Figure 16:
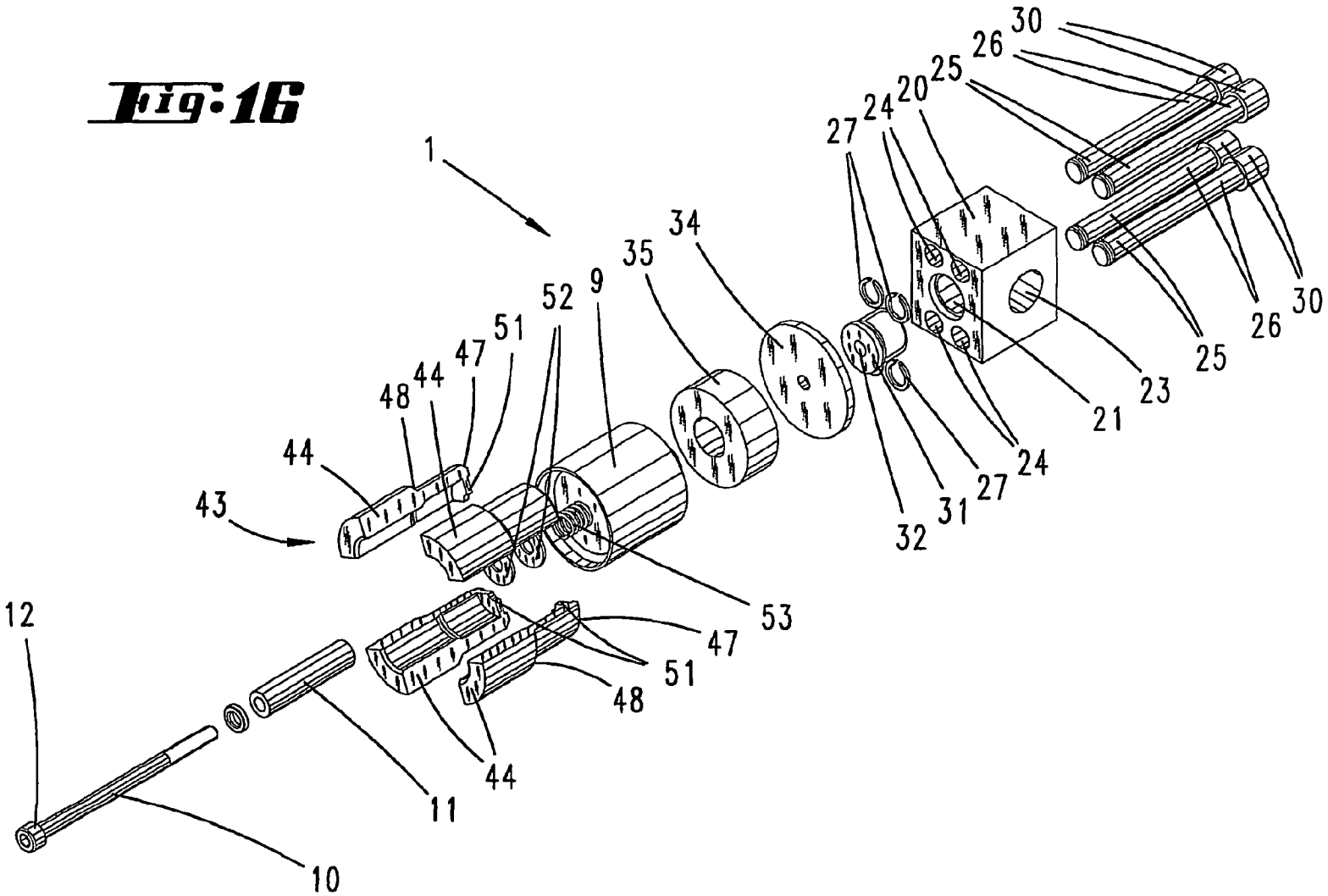
FIG. 16 shows a perspective exploded illustration of the expansion tool.
Figure 17:
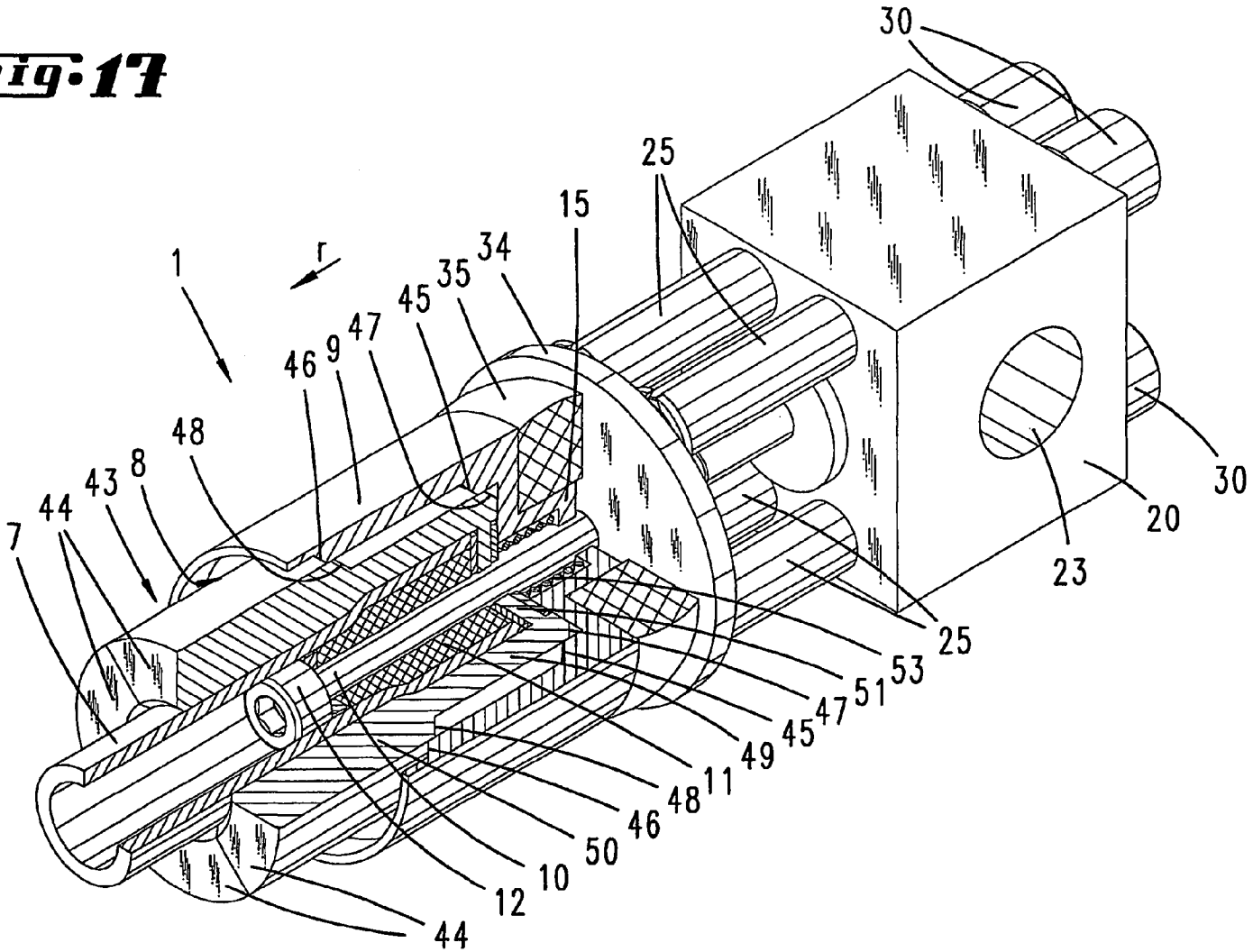
FIG. 17 shows an illustration corresponding to FIG. 14, but this time relating to the pressing position.

The arrangement of the female sub-dies 44 in the starting position according to FIGS. 14 and 15 is selected such that those side surfaces of the female sub-dies 44 which are oriented towards one another, at a distance apart from one another, leave a gap between them. Furthermore, the radially inner end periphery of the carry-along portions 51 is also spaced apart from the pull rod 10.

It is also the case in this exemplary embodiment that, in order to expand a tube end 7 introduced into the free annular space between the pull rod 10 and the female sub-dies 44, the push-rod elements 25 or rams 26 are forced in the movement direction r. Accordingly, the counter-support 9 is displaced counter to the anchored pull rod 10 via the pressure plate 34 and the force-limiting device 35.

During this displacement, the expansion element 11 is compressed via the carry-along portions 51 of the female sub-dies 44, which are carried along via the counter-support 9, the female sub-dies 44 being carried along in this way until the force to which the carry-along portions 51 are subjected by the expansion element 11 is greater than the force to which the carry-along portions 51 are subjected in the opposite direction by the compression spring 53. This results in the female sub-dies 44 being displaced relative to the counter-support 9, the guide protrusions 47, 48 and the guide slopes 45, 46 leading to an axis-parallel radial displacement of the female sub-dies 44 in the direction of the pull rod 10. This displacement of the female sub-dies 44 in the radially inward direction is stop-limited by virtue of the abutment portions 50 being positioned on the outer wall of the tube which is to be expanded and/or by virtue of those side surfaces of the female sub-dies 44 which are oriented towards one another being positioned one upon the other.

During the further advancement of the counter-support 9, the expansion element 11 is further compressed. As a result, the tube end 7 is forced into the abutment portions 50 of the female sub-dies 44 and expanded.

Figure 18:
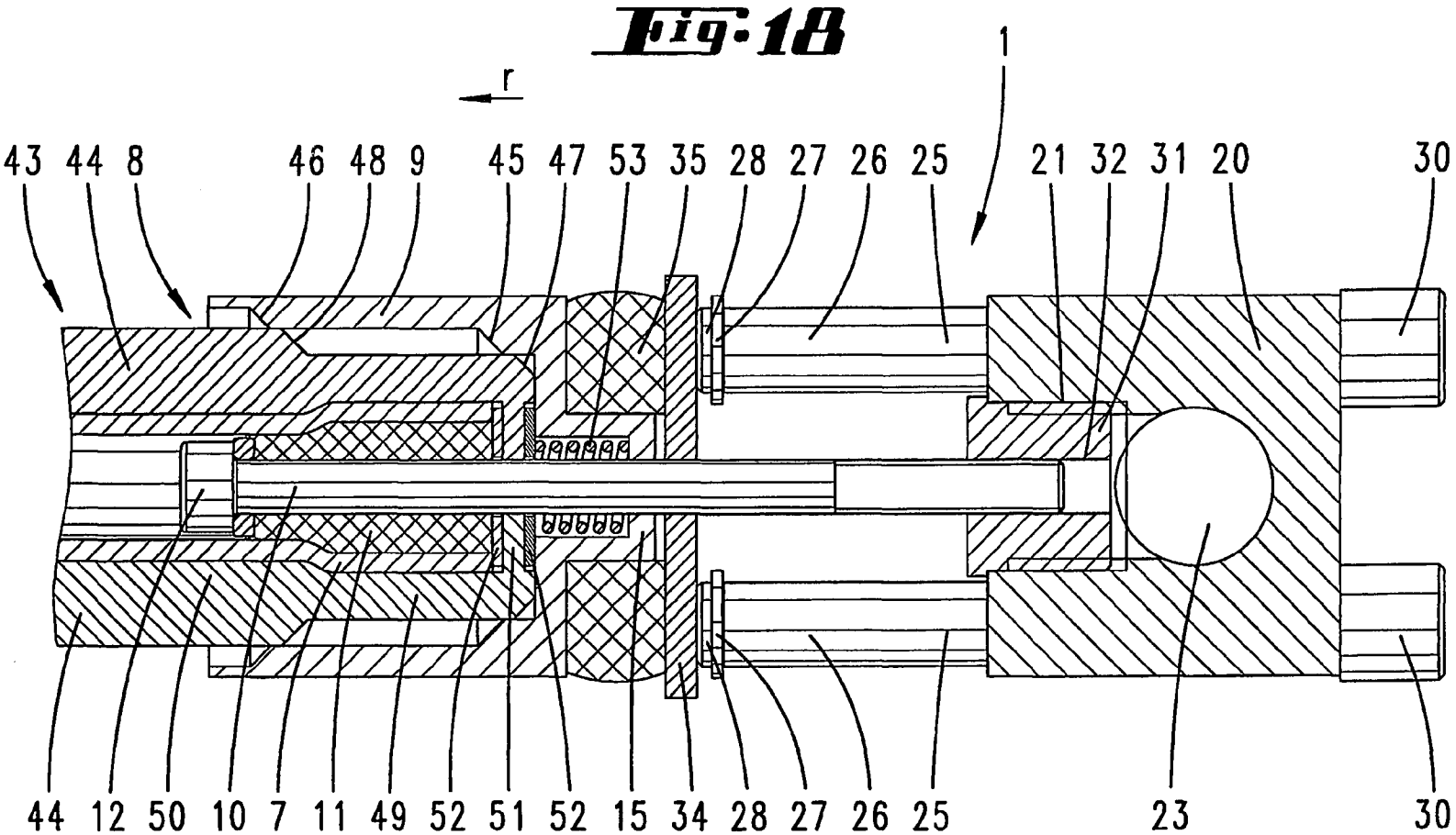
FIG. 18 shows the longitudinal section according to FIG. 15, but this time relating to the position according to FIG. 17.
Figure 19:
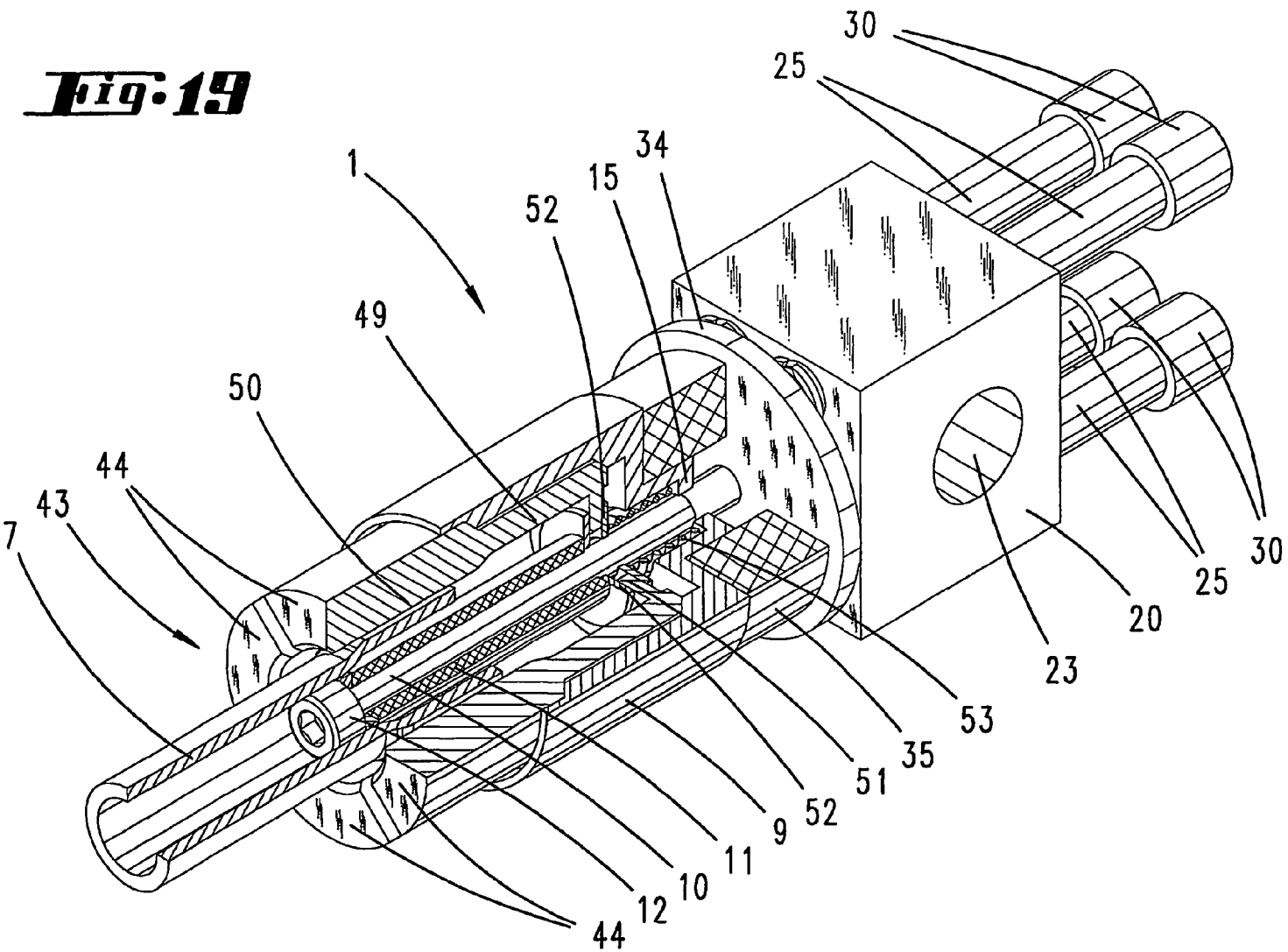
FIG. 19 shows a further illustration corresponding to FIG. 14, this time following expansion of a tube end.
Figure 20:
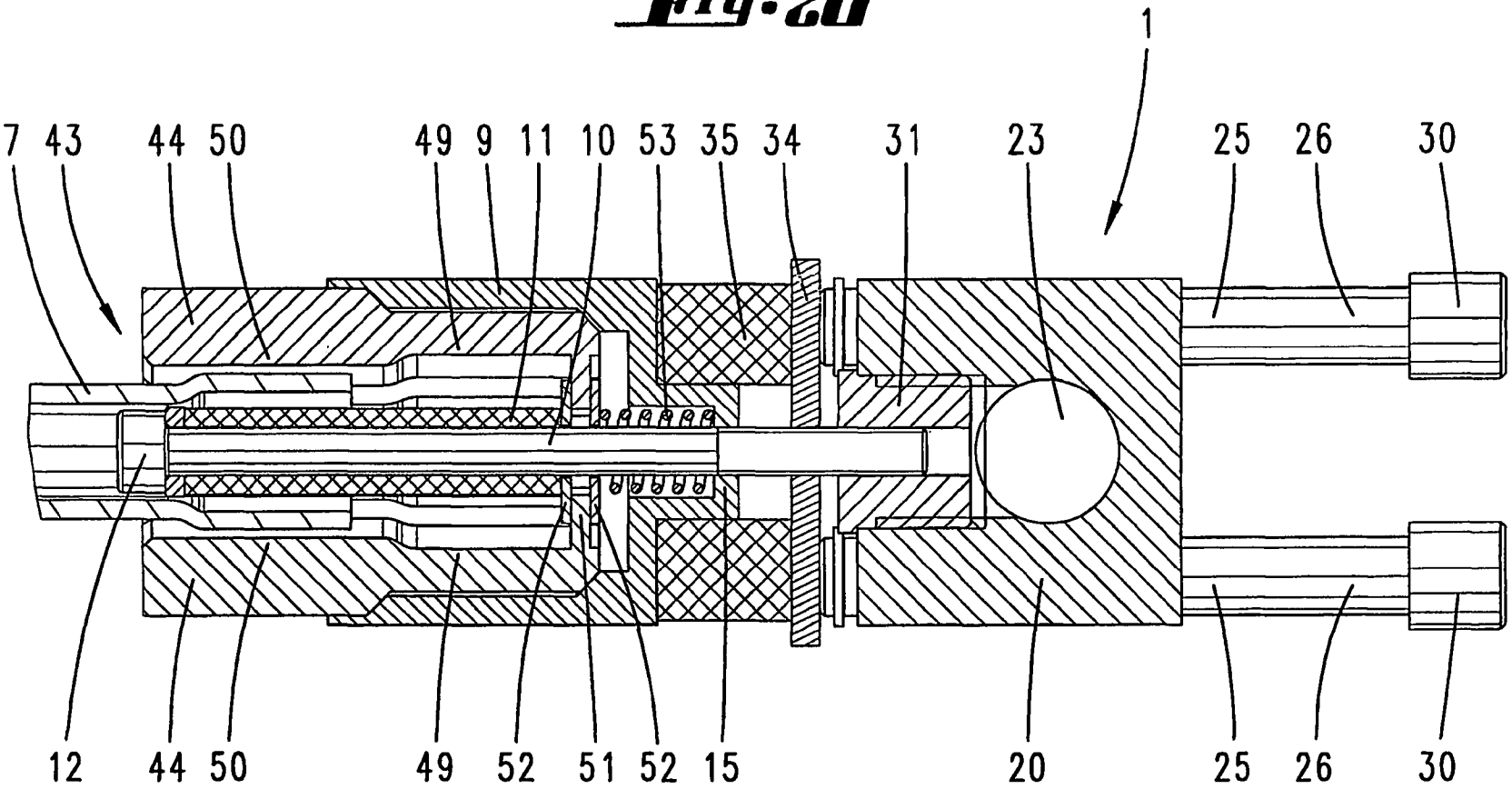
FIG. 20 shows the longitudinal section in respect of FIG. 19.

As can be gathered, in particular, from the sectional illustration in FIG. 18, the female sub-dies 44 are supported in the radially outward direction on the planar cup wall of the counter-support 9 which is formed between the guide slopes 45 and 46, so that radial yielding of the tube end 7 outside the desired expansion zone is countered in this way.

As a result, controlled expansion of the tube end 7 in a manner which is predefined by the shaping of the female sub-dies 44 is made possible.

If, once expansion has taken place, the pressing tool 2 has automatically moved back into its starting position, the counter-support 9 is displaced back into the starting position again via the carry-along portion 51 of the female sub-dies 44, as a result of the elastic restoring properties of the expansion element 11. Thereafter, the female sub-dies 44, in the first instance, are still located in their radially inwardly displaced position, albeit without being supported in the radially outward direction by the cup wall of the counter-support 9. The tube end 7 can then extremely easily be drawn out of the expansion tool 1 in the axial direction, the female sub-dies 44 being displaced radially outwards in the process as a result of the slopes which are formed between the expansion portions 49 and abutment portions 50, and are also formed in the expanded tube end 7. This then establishes the starting position according to FIGS. 14 and 15 for the expansion tool 1.

It is advantageously possible for the expansion tool 1 described to be disposed on a conventional pressing device 2.

All features disclosed are (in themselves) pertinent to the invention. The disclosure content of the associated/attached priority documents (copy of the prior application) is hereby also included in full in the disclosure of the application, also for the purpose of incorporating features of these documents in claims of the present application.

The invention claimed is:

1. An expansion tool for expanding tube ends comprising:

an expansion mandrel including a pull rod and an elastic rubber expansion element having a foot end which surrounds said pull rod, said pull rod having an axis defining an axial direction; and a counter-support supporting the expansion element at the foot end and surrounding said expansion element radially at a spacing therefrom, fastening element in which said pull rod is anchored, said fastening element having a push-rod element which extends beyond an end of said fastening element in said axial direction of said pull rod, and a bolt connecting said fastening element to a device acting on the push-rod element, and the counter-support being engageable by said push-rod element.

2. An expansion tool according to claim 1, wherein the fastening element has a bolt-accommodating bore running transversely to the axial direction defined by the pull rod.

3. An expansion tool according to claim 1, wherein the push-rod element is secured in the counter-support.

4. An expansion tool according to claim 1, wherein the push-rod element passes through the fastening element.

5. An expansion tool according to claim 1, wherein the push-rod element is a ram.

6. An expansion tool according to claim 1, wherein more than two push-rod elements are provided.

7. An expansion tool according to claim 1, wherein said counter-support is in cup form having a cup base, an inside of the cup base having a step which accommodates a foot region of the expansion element.

8. An expansion tool according to claim 7, wherein the step provides a stop for a tube end which is to be expanded.

9. An expansion tool according to claim 1, wherein a screw-in adapter part is provided in the fastening element for adaptation to different pull-rod diameters.

10. An expansion tool according to claim 1, further including a pressure plate disposed upstream of the counter-support, the push-rod element acting on said pressure plate, and a force-limiting device disposed between the pressure plate and the counter-support.

11. An expansion tool according to claim 10, wherein the force-limiting device comprises a plastics-material component.

12. An expansion tool according to claim 11, wherein the plastics-material component has a higher stiffness than the expansion element.

13. An expansion tool according to claim 1, further including an expansion transition element disposed downstream of the expansion element, said expansion transition element being held captive by the pull rod.

14. An expansion tool according to claim 13, wherein the expansion transition element comprises a plastics-material component with stop-limited compression.

15. An expansion tool according to claim 14, wherein the stop-limited compression comprises a stop sleeve which can be moved against stop ring which bounds the expansion element.

16. An expansion tool according to claim 15, wherein the stop sleeve has a sleeve base which is acted upon by a head of the pull-rod and merges into a tubular portion which surrounds the pull rod.

17. An expansion tool according to claim 1, further including a female-die element within the counter-support.

18. An expansion tool according to claim 17, wherein said female-die element is longitudinally split and is made up of a plurality of female sub-dies.

19. An expansion tool according to claim 17, wherein the female-die element engages beneath the elastic rubber expansion element.

20. An expansion tool according to claim 1, wherein during pressing, a female sub-die can be displaced axially from a removal position for the tube end which is to be expanded into a pressing position, the radial distance from the pull rod being reduced during pressing.

21. An expansion tool according to claim 17, wherein the counter-support (9) has a guide slope formed or an interior thereof, said female-die element having a guide protrusion, said guide slope interacts with said guide protrusion.

22. An expansion tool according to claim 17, wherein in the axial direction the counter-support has two spaced-apart guide slopes formed on an interior thereof, said guide slopes being disposed at different radial spacing from the pull rod.

23. An assembly comprising:

a pressing device; and an expansion tool for expanding tube ends, the expansion tool having an expansion mandrel comprising a pull rod and an elastic rubber expansion element having a foot end which surrounds the pull rod, and a counter-support supporting the expansion element at the foot end of the elastic rubber expansion element and surrounding said expansion element radially at a spacing therefrom, a push-rod element moveable by said pressing device, the pull rod being fixedly connected to the pressing device, while the counter-support being engageable by said push-rod element.

24. An assembly according to claim 23 wherein the pull rod is anchored in a fastening element.

25. An assembly according to claim 24, wherein the push-rod element projects beyond an end of the fastening element in the axial direction defined by the pull rod.

26. An assembly according to claim 24, wherein the fastening element has a bolt-accommodating bore running transversely to the axial direction of the pull rod.

27. An assembly according to claim 24, wherein the push-rod element passes through the fastening element.

28. An assembly according to claim 23, wherein more than two push-rod elements are provided.

29. An assembly according to claim 23, wherein the push-rod element is a ram which butts against the counter-support, but is not connected thereto.

30. An assembly according to claim 29, wherein the pressing device acts on the push-rod element via rollers.

31. An expansion tool for expanding tube ends comprising:

an expansion mandrel comprising a pull rod and an elastic rubber expansion element having a foot end which surrounds the said pull rod, said pull rod having an axis defining an axial direction;

a counter-support supporting the expansion element at the foot end and surrounding the foot end radially at a spacing therefrom;

a bolt-fastening element having two sides, said pull rod being anchored in said bolt-fastening element;

a push-rod element which extends on both sides beyond the bolt-fastening element in said axial direction of the pull rod, said counter-support being engageable by said push-rod element; and a bolt-accommodating bore provided in said bolt-fastening element, said bolt-accommodating bore extending transversely to the longitudinal direction of the pull rod.

* * * * *